United States Patent [19]

Shimokawa

[11] 4,261,070

[45] Apr. 14, 1981

[54] SWIMMING RING BAND

[76] Inventor: Kiyoshi Shimokawa, 3-15-10, Aso, Tobata-ku, Kitakyushu-shi, Fukuoka-ken, Japan

[21] Appl. No.: 889,488

[22] Filed: Mar. 23, 1978

[51] Int. Cl.[3] ..... B63C 9/16

[52] U.S. Cl. ..... 9/311; 9/2 F

[58] Field of Search ..... 9/2 A, 11 A, 14, 301, 9/311, 314, 329, 340, 345, 46, 2 F, 2 C, 310 F, 2 S; 403/327, 378, 379, 408

[56] References Cited

U.S. PATENT DOCUMENTS

| | | | |
|---|---|---|---|
| 1,225,023 | 5/1917 | Foote | 9/329 X |
| 2,549,475 | 4/1951 | Jardim | 9/14 X |
| 2,741,782 | 4/1956 | Müller | 9/2 S |
| 3,321,785 | 5/1967 | Soubiran | 9/345 X |
| 3,332,117 | 7/1967 | McCarthy | 403/327 X |

FOREIGN PATENT DOCUMENTS

| | | | |
|---|---|---|---|
| 2009794 | 9/1971 | Fed. Rep. of Germany | 9/11 A |

*Primary Examiner*—Sherman D. Basinger
*Attorney, Agent, or Firm*—Holman & Stern

[57] ABSTRACT

This invention discloses an improved inflatable swimming ring. Two semicircular and light-weight, hard members are adhesively welded on an outer face of a conventional swimming ring band, the ends of which members are adapted automatically to be connected with each other by the tensile force on the internal pressure of the swimming ring when it is inflated. Conversely, the two members are spontaneously separated as air within the swimming ring band is exhausted, making it easier to store the band. With this invention it is possible to prohibit the distortion and the deformation of a conventional swimming ring, to stabilize the ring and to facilitate its multipurpose usage.

2 Claims, 7 Drawing Figures

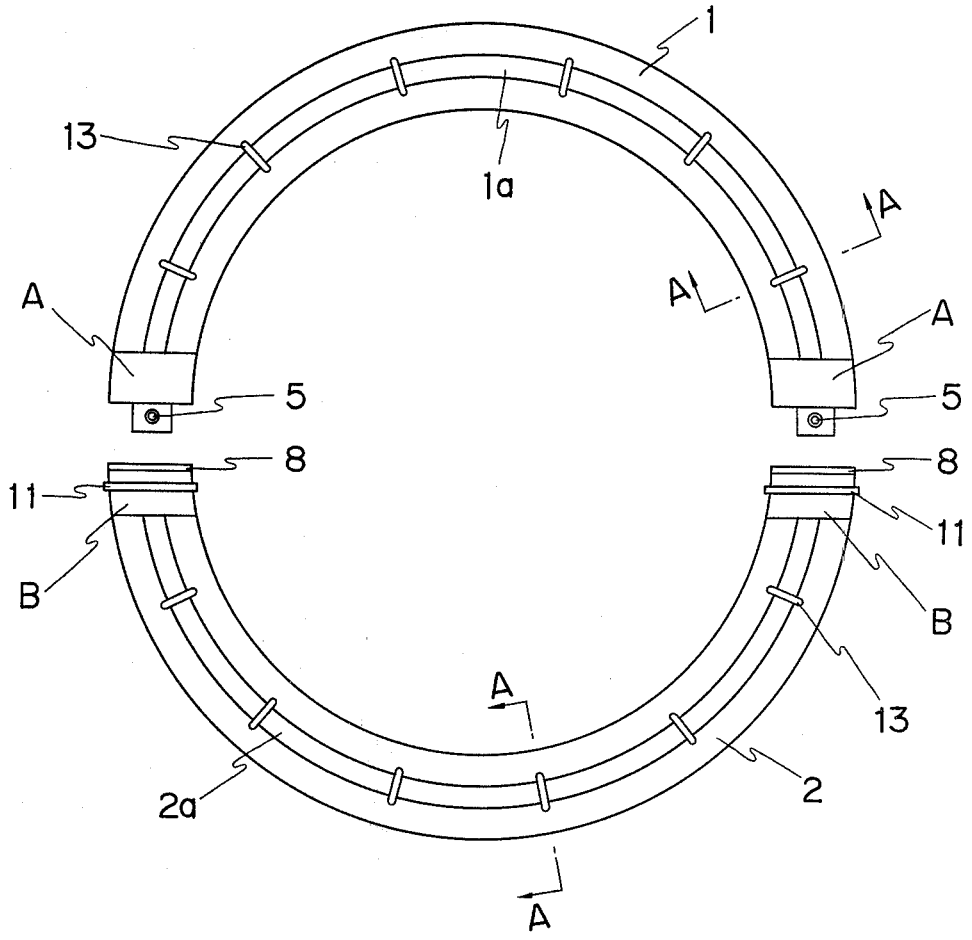
FIG. 3
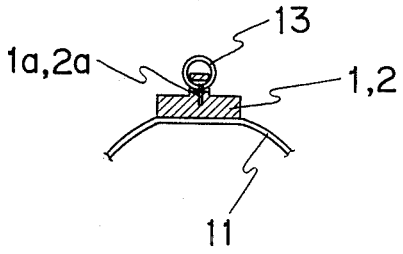

SWIMMING RING BAND

BACKGROUND OF THE INVENTION

The present invention relates to an inflatable endless swimming ring and particularly to an improvement designed to prevent distortion and deformation, to secure safety of operation and stability of the ring for multipurpose utilization.

A conventional inflatable swimming ring is not only unstable in operation, but also the pressure in said ring tends to become unbalanced leading to distortion and deformation.

The present invention substantially eliminates the above-mentioned defects and allows the user to do other actions like photographying and emergency rescue in the water.

SUMMARY OF THE INVENTION

It is an object of the invention to provide an inflatable swimming ring which is not subject to the distortion and deformation of an ordinary swimming ring in use and additionally to secure the safety and stability of the user. To this end, two members of semi-circular ring-like form are adhesive welded on an outer face of said swimming ring with their ends adjacent each other. The ends of one member are of convex shape with resiliently biased connectors. The ends of the other member are of recess shape and interfit with the ends of the first member when the ring is inflated, the ends of the two ring-like members are urged together due to the internal air pressure in the ring and the ends automatically snap together. When the ring is deflated, the resiliently biased connections on the one member automatically disconnect from the other member, and the members become separated so that the ring can be readily folded for storage.

BRIEF DESCRIPTION OF THE DRAWING

FIG. 2 is a top plan view of a pair of ring-like members of the band shown in a disconnected condition.

FIG. 3 is a sectional view of one of the members shown in FIG. 2.

DESCRIPTION OF THE PREFERRED EMBODIMENT

Figure 1:
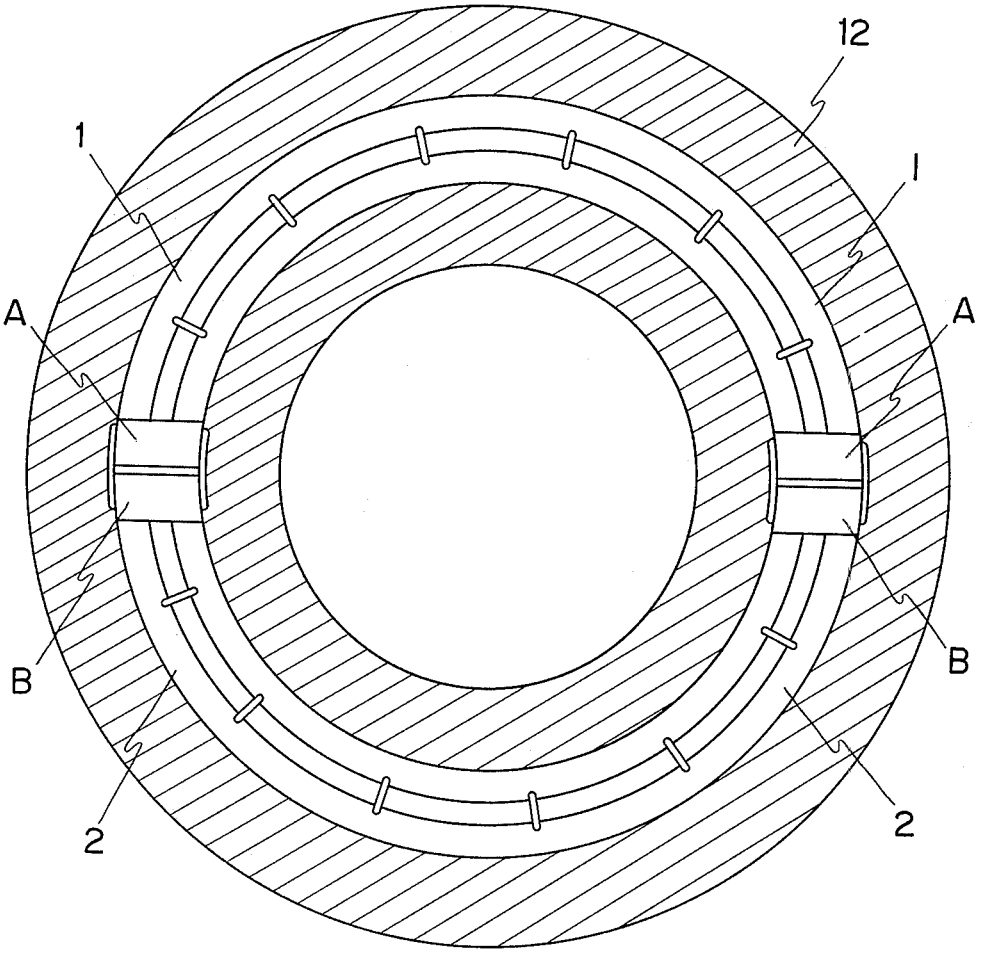
FIG. 1 is a plan view of a swimming ring in an inflated condition.

FIG. 1 is a plan view of an inflatable swimming ring 12, on one outer face of which along the center line are adhesively applied a pair of semicircular light-weight and hard members 1 and 2, the ring being shown in an inflated condition with the adjacent ends of the respective members 1 and 2 being mutually connected. As shown in FIG. 2 when air is exhausted from said swimming ring band 12, the end parts A and B of member 1 and member 2 are disconnected, members 1 and 2 having a sectional shape as shown in FIG. 3.

Figure 4:
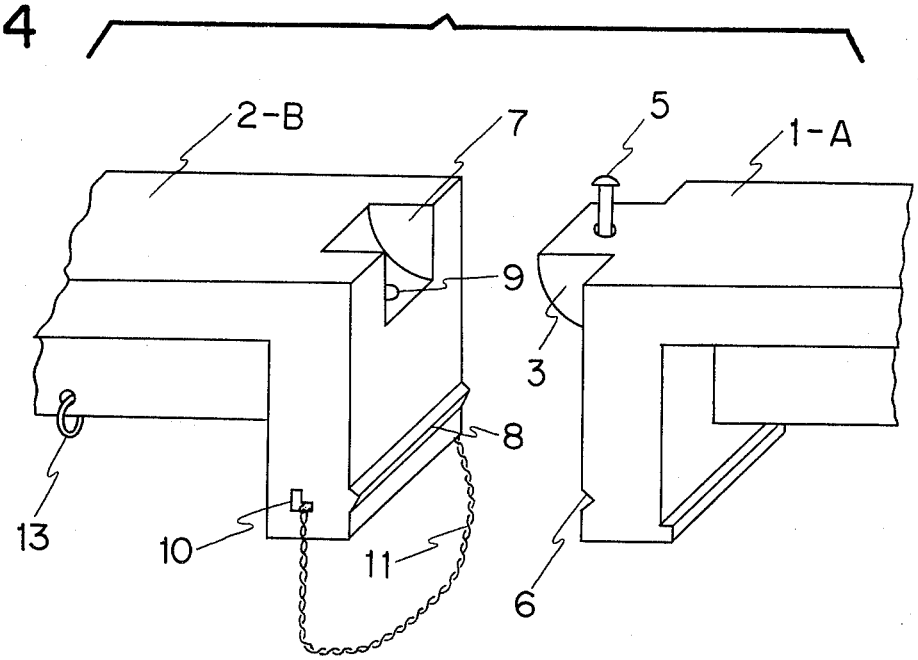
FIG. 4 is a perspective view showing the ends of both members.

Both of said members 1 and 2 are provided with stud bolts 13 and the ends A of member 1 are formed with convex protrusions including pin 3, and connectors 5 which are provided with springs 4 to urge the connections upward as shown in FIG. 4. The lower parts of said ends A are provided with grooves.

The ends B of member 2 consist of recess parts 7 complimentary to the protrusions 3 and ribs 8 to be inserted into said grooves 6. In the bottom of the recess parts 7 are holes 9 in order to receive connectors 5.

Figure 5:
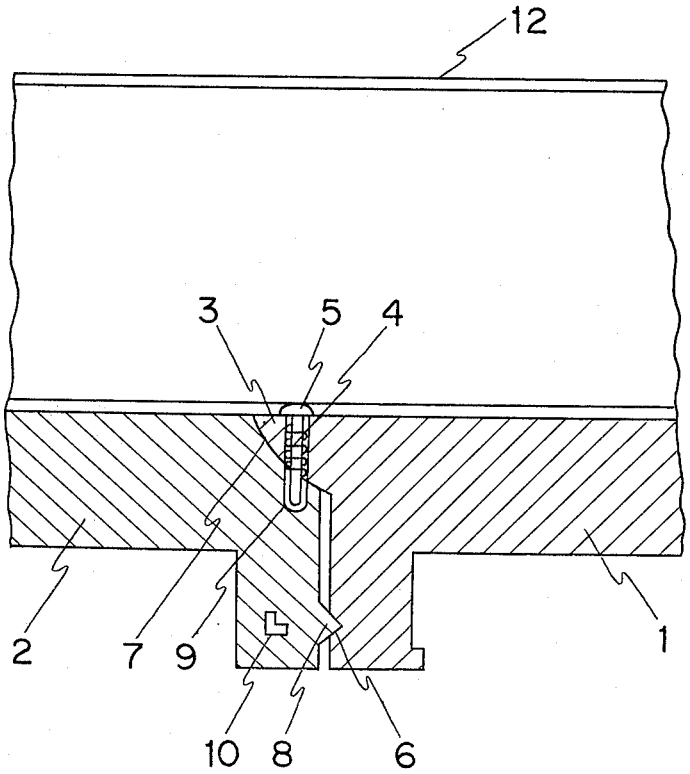
FIG. 5 is a sectional view showing a connection between the ends of both members then applied to a swimming ring.
Figure 6:
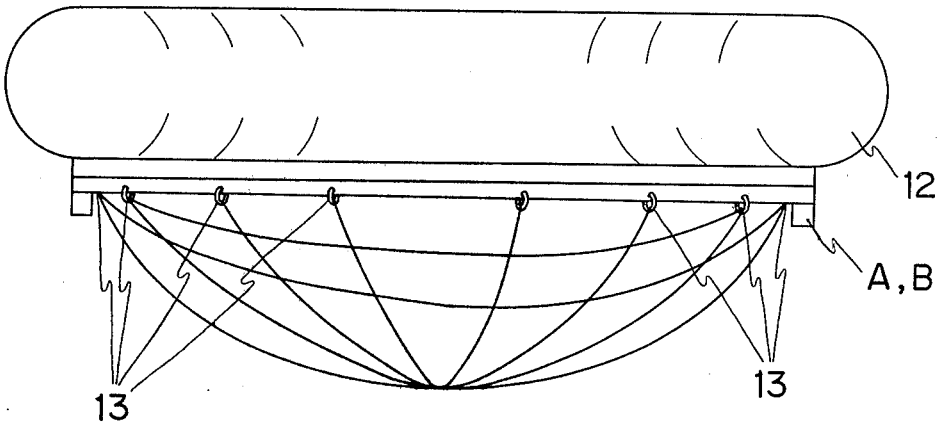
FIG. 6 is a side view showing a swimming ring with a supplementary net bag.
Figure 7:
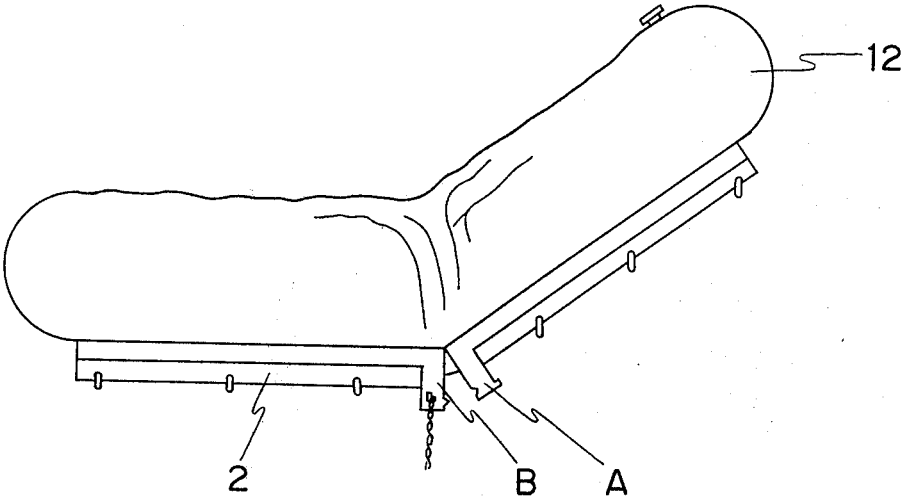
FIG. 7 is a side view showing how the swimming ring is folded.

The swimming ring also is provided with safety ropes 11 in through holes 10 in ends B of member 2, in order to secure the connection between members 1 and 2, however, FIG. 5 shows an embodiment of connected members 1 and 2 without said safety ropes.

When air is first introduced into the folded swimming ring 12, the ring is expanded and protrusions 3 on ends A of member 1 of the lower part of the swimming ring band are inserted into the recess parts 7 of ends B of member 2, and support ridges 8 and grooves 6 are inserted into each other.

Having originally been pushed upward by springs 4 when air is introduced to the ring, the heads of connectors 5 are compressed downwardly by the force of the internal pressure in the swimming ring 12, so that lower parts of the connectors 5 are fitted into holes 9 in the recess parts 7 of member 2. Consequently, member 1 and member 2 are automatically connected when the ring 12 is inflated.

It is expedient to hang a supplementary bag which consists of a known net or belt, on stud bolts 13. With or without such bag, however, members 1 and 2 are kept connected by the internal force of the swimming ring 12, as mentioned above. Therefore, there is no movement induced between these members, and deformation of the swimming ring is prevented.

When the swimming ring band 12 of this invention is to be put back in store, safety ropes 11 are taken off by hand and the ring deflated so that the pressure on connectors 5 is gradually released. The connectors 5 are pushed upwardly by springs 4 and the connection between ends A and ends B of members 1 and 2 is released. Accordingly, the swimming band 12 is folded easily at both ends, and can be put back in store.

Instead of being adhered to the surface of the ring 12, the members 1 and 2 can be suspended slightly from the ring by an amount which still causes engagement of connectors 5 in holes 9 when the ring is inflated.

What is claimed is:

1. A swimming aid comprising and endless inflatable ring, a pair of semicircular ring-like members secured to the ring substantially coaxially therewith, said ring-like members having adjacent ends and means for automatically connecting the ends of one of said members to the ends of the other of said members when the ring is inflated and disconnecting the respective ends of said members when the ring is deflated; and wherein said automatic connecting and disconnecting means includes a pin connector in an end of one of said members, an opening adapted to receive said pin in an adjacent end of the other of said members, means urging said pin out of engagement with said opening and the positioning of said members relative to said ring causing internal pressure in said ring when the ring is inflated to operate to move said connector into said opening against the action of said urging means and said urging means overcoming said forces when the ring is deflated to move said connector out of said opening.

2. The swimming aid as defined in claim 1 wherein said end of said member including said connector has a protruding portion in which said connector is housed and said adjacent end of said other member has a recessed portion complementary to the protruding portion, said opening being formed in said recessed portion.

* * * * *